US007914207B1

(12) United States Patent
Beam

(10) Patent No.: US 7,914,207 B1
(45) Date of Patent: Mar. 29, 2011

(54) DRAW TAPE BAG, ADHESIVE STRIP THEREFOR AND METHODS OF MAKING THE SAME

(76) Inventor: Elizabeth Jane Beam, Ozark, MO (US)

( * ) Notice: Subject to any disclaimer, the term of this patent is extended or adjusted under 35 U.S.C. 154(b) by 652 days.

(21) Appl. No.: 12/005,187

(22) Filed: Dec. 26, 2007

Related U.S. Application Data

(60) Provisional application No. 60/906,138, filed on Mar. 9, 2007.

(51) Int. Cl.

| | |
|---|---|
| ***B65D 33/14*** | (2006.01) |
| ***B65D 33/28*** | (2006.01) |
| ***B65D 33/04*** | (2006.01) |
| ***B65D 30/20*** | (2006.01) |
| ***B65D 25/14*** | (2006.01) |

(52) U.S. Cl. ..... 383/11; 383/75; 383/106; 383/120; 220/495.11

(58) Field of Classification Search ..... 383/11, 383/75, 120, 104, 106; 220/495.11
See application file for complete search history.

(56) References Cited

U.S. PATENT DOCUMENTS

| | | | | |
|---|---|---|---|---|
| 3,148,799 | A * | 9/1964 | Meroney | 220/495.11 |
| 4,842,421 | A * | 6/1989 | Bullard et al. | 383/61.4 |
| 4,878,764 | A * | 11/1989 | Meyer | 383/72 |
| 4,904,092 | A | 2/1990 | Campbell et al. | |
| 4,978,231 | A | 12/1990 | Ling et al. | |
| 5,913,606 | A | 6/1999 | Nicholson | |
| 6,602,174 | B1 | 8/2003 | Haverfield et al. | |
| 6,808,073 | B2 | 10/2004 | Cuisinier | |
| 6,837,394 | B2 | 1/2005 | Nnamani | |
| 7,137,737 | B2 | 11/2006 | Schneider | |
| 2005/0129335 | A1 | 6/2005 | Paul | |

FOREIGN PATENT DOCUMENTS

| | | | |
|---|---|---|---|
| FR | 2720918 | A1 * | 12/1995 |
| GB | 2231027 | A * | 11/1990 |
| JP | 2001199502 | A * | 7/2001 |

* cited by examiner

*Primary Examiner* — Jes F Pascua
(74) *Attorney, Agent, or Firm* — Richard L. Marsh

(57) ABSTRACT

A liner for a waste receptacle comprises a first wall, a second wall, at least one draw tape hem, at least one draw tape and at least one adhesive strip. The second wall is an extension of the first wall and is laid adjacent the first wall. The draw tape hem is an extension of at least a portion of the free ends of the walls and has the draw tape laid adjacent the terminal end of those free ends. The terminal end of the free ends are folded over the draw tape and joined to the inside surface of the walls. The first wall and the second wall may be joined together along the terminal side edges or may be seamless. The adhesive strip is applied to an exterior surface of the draw tape hem and is provided with a removable protective cover.

13 Claims, 5 Drawing Sheets

40

DRAW TAPE BAG, ADHESIVE STRIP THEREFOR AND METHODS OF MAKING THE SAME

CROSS REFERENCE TO RELATED APPLICATIONS

This application is a non-provisional application of Applicant's Provisional Application Ser. No. 60/906,138 filed on 9 Mar. 2007.

BACKGROUND OF THE INVENTION

1. Field of the Invention

This invention relates to a draw tape bag with an adhesive strip on at least a portion of the periphery of the draw tape hem, the draw tape bag conventionally used as a waste can liner.

2. Prior Art Statement

It is known to provide a trash can liner an adhesive patch disposed on the exterior surface of the draw tapes in the area of a cutout in the hem. After inserting the liner into the can and folding the closure end of the bag over the rim of the can, an end of the tape is drawn tight and secured to the adhesive patch to retain the liner in the can. The adhesive patch is initially covered with a strippable cover. For instance, see the U.S. Pat. No. 7,137,737 B2 issued on Nov. 21, 2006 to Jakob Schneider. The adhesive portion is provided only on an end of the draw tape for securing the draw tape tightly around the exterior of the can below the rim. Also, the liner is a conventional type liner that is folded over the rim of the can which covers the rim of the can thus detracting from the aesthetics of a decorative waste can. Furthermore, the liner is of conventional opaque material further hiding any decorative features of the can. Additionally, since the liner extends over the rim, material is wasted in manufacture and that added material contributes to landfill waste. Thus there is a need for a waste can liner that comprises a first wall, a second wall, a closed bottom and an open top, where the open top contains a draw tape within a hem and where the hem further has an adhesive strip applied to an exterior surface thereof for adhering the liner to an inside surface of a waste container.

It is also known to provide a trash can liner that has an adhesive strip at the top edge for adhering the liner to the inside of the trash can and/or to other surfaces inside the receptacle. For instance, see the U.S. Patent Publication 2005/0129335A1 published on Jun. 16, 2005 by Samuel Louis Paul. Only a small area is provided with means to adhere the bag to the can which leads to gaps between the edges of the can and the liner. Additionally, no draw tape is provided thus making the liner difficult to remove from the can. Another liner has an adhesive strip on the exterior of a waste bag for adhering a portion of the waste bag to a stationary object such as a wall or tree. A tab is provided on the end of the adhesive strip for facilitating closure of the bag when full. For instance, see the U.S. Pat. No. 5,913,606 issued on Jun. 22, 1999 to Jerome Nicholson. The adhesive on the bag of Nicholson is disposed well below the top edge of the bag and thus also results in wasted material and additional landfill material. A similar liner is described in Campbell, et al., U.S. Pat. No. 4,904,092 issued on Feb. 27, 1990 which provides an adhesive strip across the top of the bag to facilitate opening the bag when withdrawing a bag from a stack or roll. The adhesive is said to be useful in retaining the bag closed by twisting the bag at the location of the adhesive. The liner of Campbell, et al., cannot be fitted with a draw tape in a hem and maintain the liners in a roll and the liners of Paul and Nicholson do include a draw tape disposed within a hem with the adhesive on the exterior of the hem. Therefore, there is a need for a waste can liner that comprises a first wall, a second wall, a closed bottom and an open top with a draw tape within a hem in the top thereof wherein the hem further has an adhesive strip applied to an exterior surface thereof, the hem provided with a cutout in a portion thereof for access to the draw tape, the adhesive strip comprising a high tack surface and a low tack surface where the high tack surface applied to the external surface of the hem and the low tack surface is covered with the removable protective strip.

It is further known to provide a trash bag that has an adhesive strip at the top of the bag on both the inside and outside of the bag. The outside adhesive layer is used to secure the bag to the inside of the waste container and the inside adhesive is used to close the bag. The adhesive layers have peelable protective strips covering the adhesive. For instance, see U.S. Pat. No. 6,837,394 B2 issued on Jan. 4, 2005 to Patricia Ann Nnamani. There is no means to reduce the size of the bag for different sized cans, no draw tape is provided nor is there a fold in the bottom of the bag. Accordingly, there is still a great need for a liner for a waste receptacle that comprises a first wall, a second wall, at least one draw tape hem, at least one draw tape and at least one adhesive strip where the first wall and the second wall are joined together along terminal side edges thereof and wherein the adhesive strip is applied to an exterior surface of the draw tape hem, a fold is provided in the bottom of the bag and an additional adhesive strip is provided reduce the size of the bag.

Finally, it is known to provide nested bag liners that have an adhesive provided on tabs extending from the upper edge of the bag to keep the bags together in a nest. The bags also of conventional structure and are intended to be rolled over the edge of the waste can. The adhesive on the tabs may additionally be used to close the bag in a half knot adhering the tabs to the outside of the bag. For instance, see the U.S. Pat. No. 6,808,073 B2 issued on Oct. 26, 2004 to Jarret P. Cuisinier. The function of the adhesive is to keep the liners together in a nest over the edge of the can. Yet another liner is shown in Ling, et al., U.S. Pat. No. 4,978,231 issued on Dec. 18, 1990 wherein an adhesive strip is located on an outside surface of the bag for adhering the bag to the outside of the receptacle. The liners are also heat melted together into a nest. Additional material is needed to extend either liner over the edge of the can as in Ling, et al., and to provide for the tab of Cuisinier at the extreme end of the liner. This results in greater production costs and contributes to additional landfill waste. Furthermore, the liner is not adhered to the inside of the receptacle. Hence, there is still a need for liner for a waste receptacle that has at least one draw tape hem disposed on an open end of the liner, at least one draw tape disposed in the hem and at least one adhesive strip applied to the exterior surface of the draw tape hem, the hem further provided with a cutout in a portion thereof for access to the draw tape peel the liner from the container.

SUMMARY OF THE INVENTION

In order to overcome the limitations of prior art liners, it is a primary object of this invention to provide a waste can liner that has a draw strip enclosed in a hem at a top end thereof and a gusset fold in a bottom end thereof, the hem further provided with at least one cutout therethrough for retrieving a portion of the draw strip when closing the liner, the hem further provided with at least two adhesive strips on an outside surface for adhering the liner to an inside surface of a rigid container thus keeping the liner in an open posture within the container.

Another object of this invention is to provide a liner for a waste receptacle that has a draw tape disposed within an integral hem carrying an adhesive strip on the outside surface thereof wherein the adhesive strip comprises a high tack surface and a low tack surface, the high tack surface applied to the exterior surface of the hem and the low tack surface covered with a removable protective strip, the hem provided with a cutout for access to the draw tape with the cutout is centrally disposed in the hem to assist in peeling the liner from the container.

A primary goal of this invention is to provide a liner for a waste receptacle comprising a first wall, a second wall, a closed bottom and an open top, the open top containing a draw tape within a hem in the top of each the wall, the hem further having an adhesive strip applied to an exterior surface thereof, the adhesive strip covered with a removable protective strip.

A significant feature of this invention is to provide a liner for a waste receptacle that comprises a first wall, a second wall, at least one draw tape hem, at least one draw tape and at least one adhesive strip, the second wall comprising an extension of the first wall, the second wall laid adjacent the first wall, the draw tape hem comprising an extension of at least a portion of a free end of the first wall and at least a portion of a free end of the second wall, wherein a portion of the draw tape is laid adjacent a terminal end of the free end of the first wall, a portion of the draw tape is laid adjacent a terminal end of the free end of the second wall, the terminal end of the free end of the first wall folded over the portion of the draw tape and joined to an inside or outside surface of the first wall and a terminal end of the free end of the second wall folded over the portion of the draw tape and joined to an inside or outside surface of the second wall, the first wall and the second wall joined together along terminal side edges thereof and wherein the adhesive strip is applied to an exterior surface of the draw tape hem.

A main purpose of this invention is to provide a waste can liner that has a draw strip enclosed in a hem at a top end thereof and a gusset fold in a bottom end thereof, the hem further provided with at least one cutout therethrough for retrieving a portion of the draw strip when closing the liner, the hem further provided with at least two adhesive strips on an outside surface for adhering the liner to an inside surface of a rigid container thus keeping the liner in an open posture within the container wherein the gusset fold comprises an inwardly directed fold joined to the terminal side edges.

A primary principle of this invention is to provide a waste can liner that has a draw strip enclosed in a hem at a top end thereof and a gusset fold in a bottom end thereof, the hem further provided with at least two adhesive strips on an outside surface for adhering the liner to an inside surface of a rigid container thus keeping the liner in an open posture within the container wherein at least the liner is constructed of a transparent or translucent material.

A principal aim of this invention is to provide a waste can liner that has a draw strip enclosed in a hem at a top end thereof and a gusset fold in a bottom end thereof, the hem further provided with at least two adhesive strips on an outside surface for adhering the liner to an inside surface of a rigid container thus keeping the liner in an open posture within the container wherein at least the liner is constructed of a transparent or translucent material and is provided with at least one decorative applique on at least one of an interior or exterior surface of the first wall and/or the second wall.

A primary aspect of this invention is to provide a liner for a waste receptacle that has a draw tape disposed within an integral hem carrying an adhesive strip on the outside surface thereof wherein the adhesive strip comprises a high tack surface and a low tack surface, the high tack surface applied to the exterior surface of the hem and the low tack surface covered with a removable protective strip, the hem provided with a cutout for access to the draw tape with the cutout is centrally disposed in the hem to assist in peeling the liner from the container and wherein at least a portion of the exterior surface of the first wall provided with an additional adhesive strip disposed transverse to the adhesive strip affixed to the hem, the additional adhesive strip covered with a removable protective strip, the additional adhesive strip adapted for reducing a periphery of the liner.

DESCRIPTION OF THE PREFERRED EMBODIMENTS

While the various features of this invention are hereinafter described and illustrated as a waste can liner provided with a draw strip enclosed in a hem at a top end thereof and a gusset fold in a bottom end thereof wherein the hem is further provided with at least two adhesive strips on an outside surface for adhering the liner to an inside surface of a rigid container thus keeping the liner in an open posture within the container, it is to be understood that the various features of this invention can be used singly or in various combinations thereof to provide for a waste can liner with an adhesive attachment, a light transmissible skin, a draw tape and size reduction means as can hereinafter be appreciated from a reading of the following description.

Figure 1:
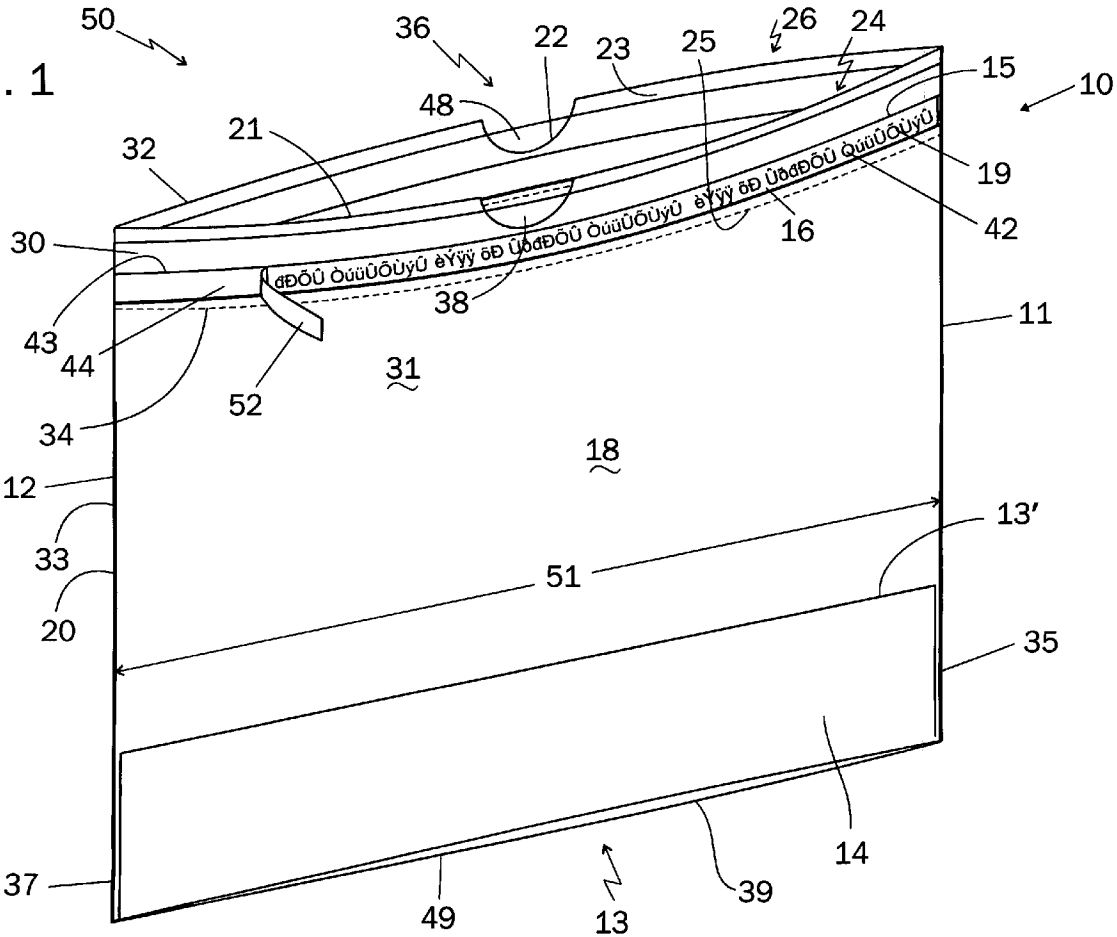
FIG. 1 is a perspective view of a preferred embodiment of the waste can liner of this invention.
Figure 2:
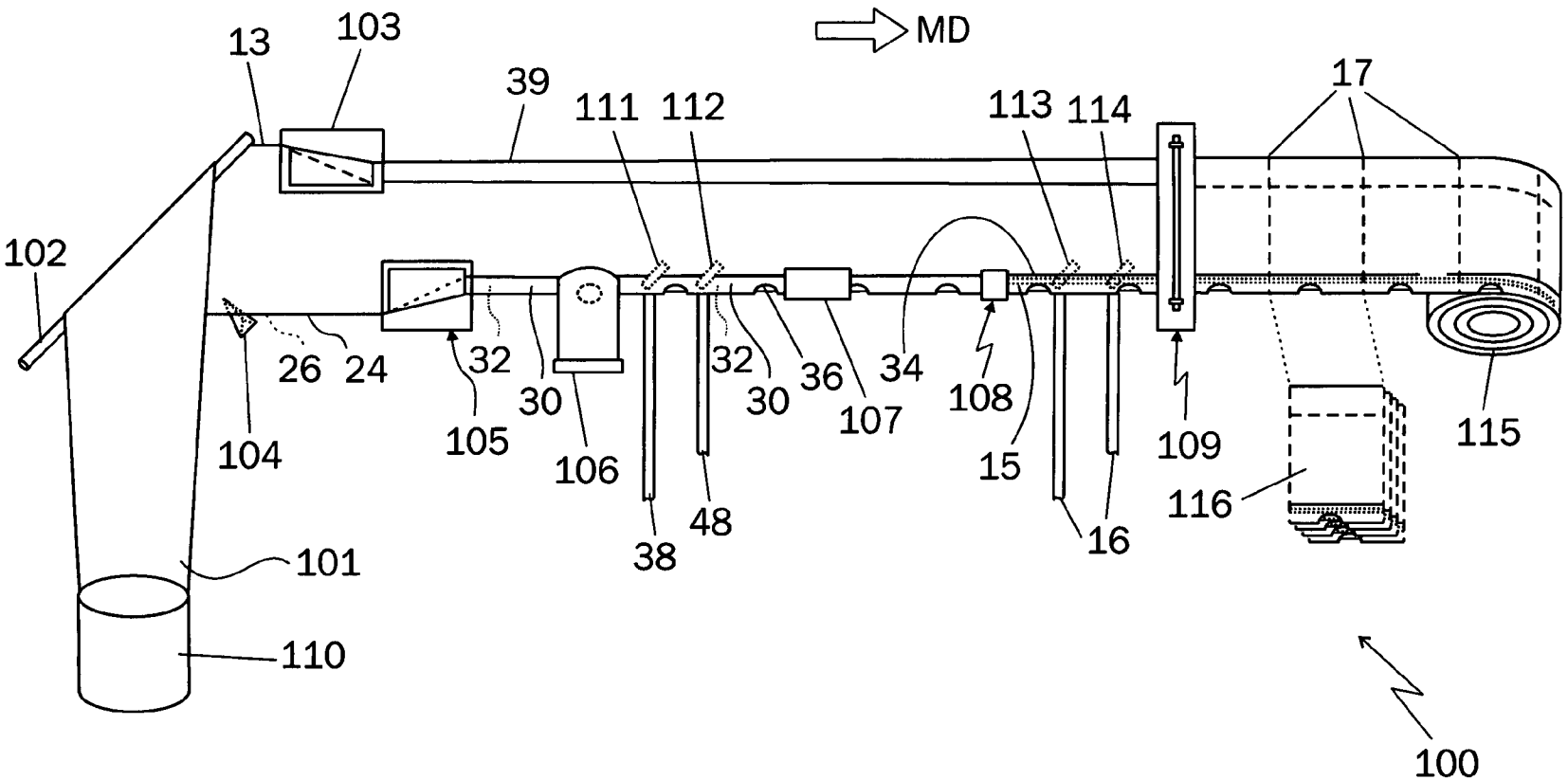
FIG. 2 is a top plan view of one apparatus for the manufacture of the waste can liner of FIG. 1.

Referring now to FIG. 1, a liner for a waste receptacle, generally shown by the FIG. 10, comprises a first wall 18, a second wall 20, at least one draw tape hem 30, 32, at least one draw tape 38, 48 and at least one adhesive strip 15, 15.' Second wall 20 is an extension of first wall 18, first wall 18 and second wall 20 created by slitting lengthwise an elongated tube 101 as shown in FIG. 2. Second wall 20 is laid adjacent first wall 18 by flattening tube 101 by suitable means such as a flattening mechanism 102. As best observed in FIG. 3, draw tape hem 30 comprises an extension of at least a portion 21 of a free end 24 of first wall 18 and draw tape hem 32 comprises at least a portion 23 of a free end 26 of second wall 20. A portion of draw tape 38 is laid adjacent a terminal end 25 of free end 24 of first wall 18 and a portion of draw tape 48 is laid adjacent a terminal end 27 of free end 26 of second wall 20 wherein terminal end 25 of free end 24 of first wall 18 is folded over draw tape 38 and preferably joined to an interior surface 28 of first wall 18 and terminal end 27 of free end 26 of second wall 20 is folded over draw tape 48 and joined to an interior surface 29 of second wall 20. First wall 18 and second wall 20 are ultimately joined together at sealing/severing joint 17 of FIG. 2 thus creating terminal side edges 11, 12 thereof after an adhesive strip 15 is applied to an exterior surface 31 of draw tape hem 30 and preferably, an adhesive strip 15' is applied to an exterior surface 33 of draw tape hem 32, adhesive strips 15, 15' covered by a removable cover 16, 16' respectively, prior to joining terminal side edges 11, 12.

Figure 3:
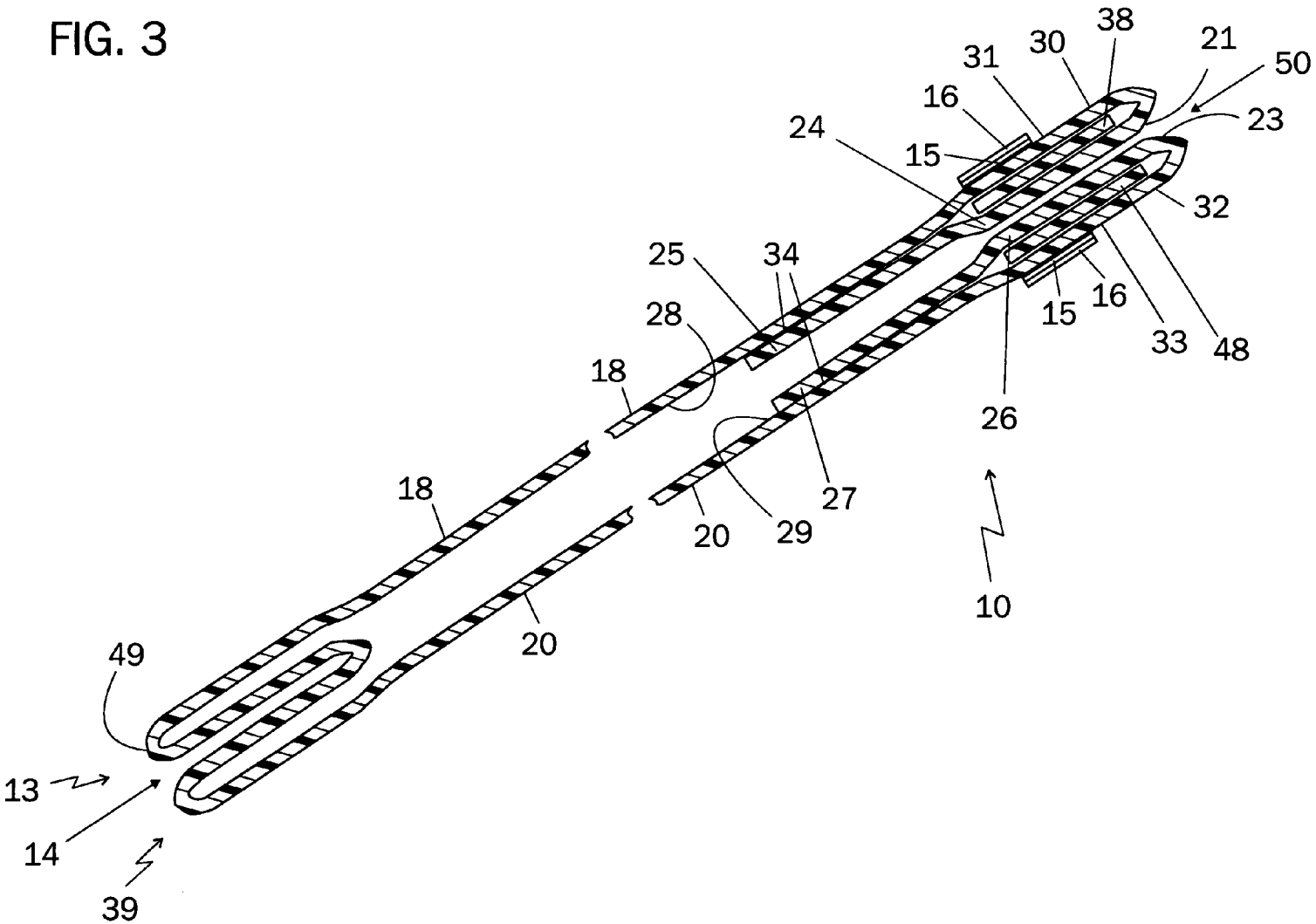
FIG. 3 is a cross section view along lines 3-3 of the waste can liner of FIG. 1.

Referring again to FIG. 1 and also to FIG. 3, adhesive strip 15 preferably is about one quarter inch in width and extends the entire length of hem 30 between terminal side edges 11, 12 and likewise, adhesive strip 15' extends the entire length of hem 32 between terminal side edges 11, 12. As covers 16, 16' are applied prior to joining walls 18, 20 together at sealing/severing joints 17, covers 16, 16' are severed at sealing/severing joints 17 by the thermal action of edge sealer/cutter 109. Covers 16, 16' are preferably printed with "TO EXPOSE ADHESIVE, REMOVE COVER," this legend 42 represented in FIGS. 1 and 4 by Greeking 19. Hems 30, 32 are provided with cutouts 36 in a portion thereof for access to draw tapes 38, 48 respectively. Preferably, cutouts 36 are about one and one half inches in width as measured along hem 30, 32 and are about one half inch in depth extending into reformed top edge 50. Cutouts 36 are typically shaped as an arch and are centrally disposed in hems 30, 32 to assist in peeling liner 10 from a container, not shown, as a centrally disposed pull on draw tapes 38, 48 provides for equal separation of adhesive 15, 15' from opposite sides of the container and from portions of the container adjacent each cutout 36. Additionally, as is well established in the art, liner 10 also allows for equal gathering of hems 30, 32 about draw tapes 38, 48 while closing liner 10 about the contents captured therein.

In the preferred embodiment of liner 10, first wall 18 and second wall 20 are provided with an inwardly directed fold 14 disposed therebetween opposite free ends 24, 26 thereof. Inwardly directed fold 14 is formed into bottom 13 by forcing walls 18 and 20 to double inwardly whereafter the newly formed folded bottom 39 is pressed to ensure that inwardly directed fold 14 is retained in liner 10 prior to sealing terminal side edges 11, 12. Accordingly, when terminal side edges 11, 12 are joined at sealing/severing joints 17, ends 35, 37 of inwardly directed fold 14 are simultaneously joined to terminal side edges 11, 12. Inwardly directed fold 14 allows for expansion of liner 10 into various shaped waste receptacles without producing a specific liner 10 for each specific waste receptacle. The depth of inwardly directed fold 14 from into folded bottom 39 may be up to about one-third of a width 51 between terminal side edges 11, 12 but is preferably about two inches (2") for liner 10 in a generally rectangular form of fourteen inches (14") in width 51 and eleven and one quarter inches (11¼") in length from reformed top edge 50 to new base 49 of folded bottom 39. Preferably, folded bottom 39 is a "C" fold having equal lengths of walls 18, 20 folded inwardly into bottom 13. As several different sized liners 10 are contemplated, it follows that folded bottom 39 is proportional to width 51 of liner 10 between terminal side edges 11, 12 in order for liner 10 to essentially stand up in a waste can when folded bottom 39 is opened.

It is preferred that liner 10 be constructed of a transparent or translucent material selected from the group comprising polyethylene, low density polyethylene, ultra low density polyethylene, polypropylene, ethylene vinyl acetate, ethylene-methyl acrylate, ethylene-ethyl acrylate, and mixtures thereof and preferably are oriented films having a greater resistive strength in one direction. Though an oriented film is preferred, it is within the scope of this invention to produce liner 10 of sheet material having equal strength in both the length of liner 10 from free ends 24, 26 to bottom 13 and width 51 of liner 10 between terminal side edges 11, 12. Removable cover 16, 16' is preferably constructed of a thermoplastic film selected from the group comprising polyethylene, polypropylene, isophthalic polyester, terephthalic polyester, orthophthalic polyester, acetals, vinyls, tetrafluoroethylenes, propylenes, styrenes, amides, amide-imides, parabenzamides, vinylchlorides, carbonates, ABS, acrylates, or combinations thereof. Most preferably, removable cover 16, 16' has one surface that will temporarily cling to adhesive 15, 15' yet readily release therefrom when peeled at an angle from adhesive 15, 15'. Removable cover 16, 16' is provided with the aforementioned legend 42 to guide the user of liner 10 toward the proper usage thereof. Draw tapes 38, 48 are typically formed from thermoplastic material selected from the group comprising polyethylene, low density polyethylene, ultra low density polyethylene, polypropylene, ethylene vinyl acetate, ethylene-methyl acrylate, ethylene-ethyl acrylate, and mixtures thereof and preferably are oriented films having a greater resistive strength in a length of draw tape 38, 48. Draw tapes 38, 48 of thermoplastic material are preferably about one inch in width, however, it is within the scope of this invention to provide for wider or narrower draw tapes 38, 48 as well as produce draw tapes 38, 48 of other materials such as natural or synthetic fibers or combinations thereof.

Figure 4:
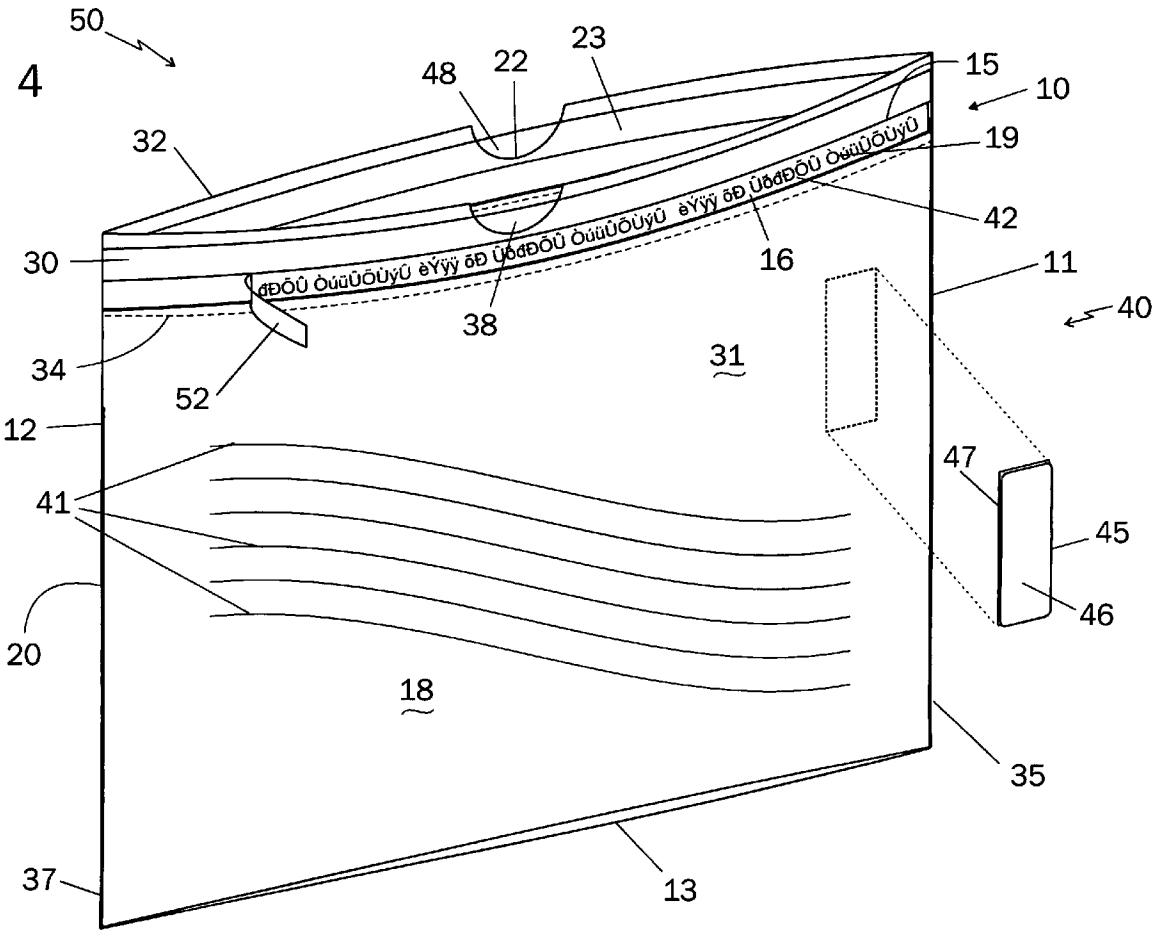
FIG. 4 is a perspective view of an alternate embodiment of the waste can liner of FIG. 1.
Figure 5C:
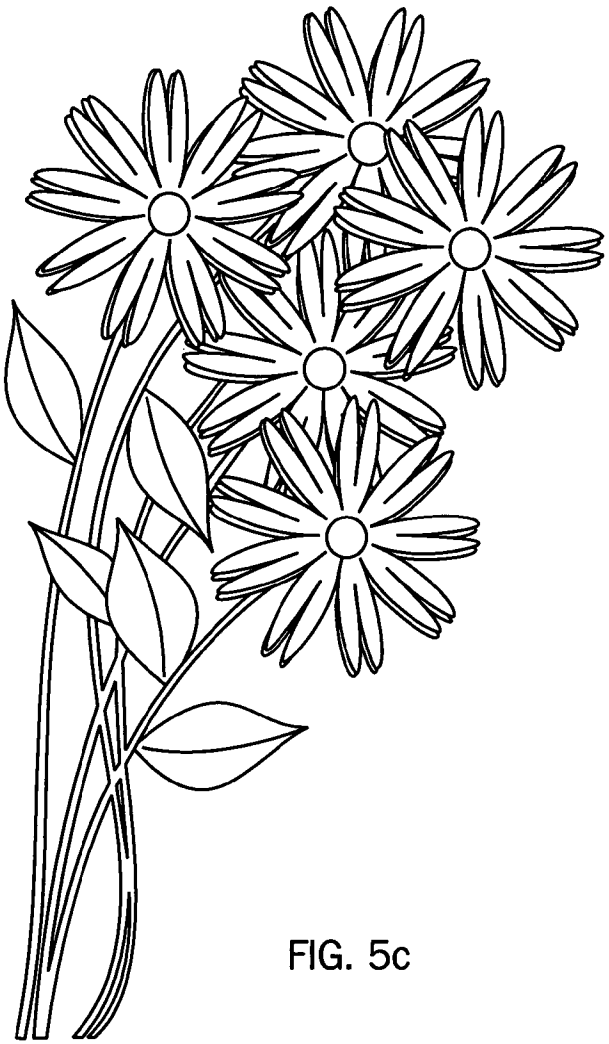
FIG. 5*a-c* are plan views of decorative items applied to the liner of FIGS. 1 and 4.
Figure 5A:
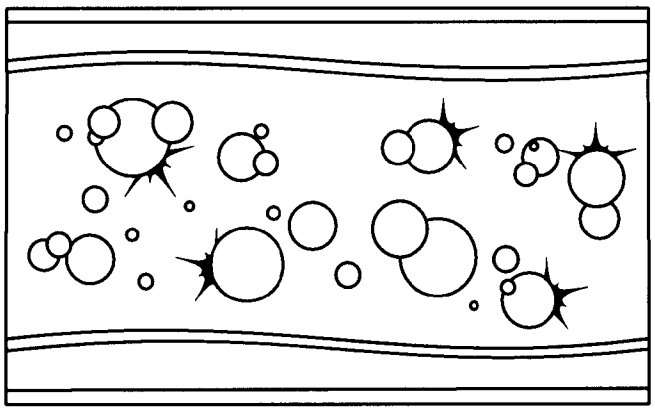
Figure 5B:
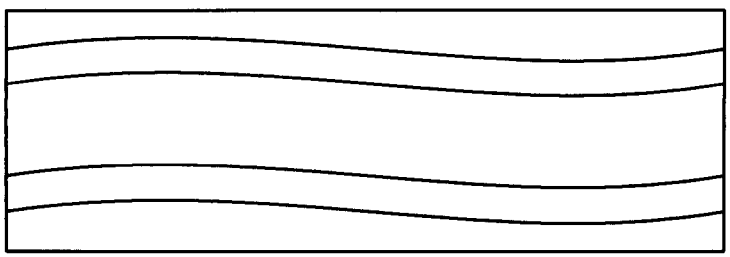

As liner 10 is constructed of a transparent or translucent material, liner 10 may alternately be provided with at least one decorative applique 40 on at least one of an interior surface 28, 29 of first wall 18 and/or second wall 20. Additionally, or alternately liner 10 may be provided with at least one decorative applique 40 on at least one of an exterior surface 31, 33 of first wall 18 and/or second wall 20. Decorative applique 40 may be of any art work, whether real or abstract, depicting still life, wildlife, heavenly bodies, shapes, patterns or objects and thus is shown in FIG. 4 only as parallel wavy lines 41. Selected designs for decorative applique 40 are shown in FIG. 5 *a-c* though other designs are within the scope of this invention. Additionally, it is within the scope of this invention to produce material for liner 10 that is colored though still translucent or transparent.

Adhesive strip 15, 15' comprises a high tack surface 43 and a low tack surface 44, high tack surface 43 applied to exterior surface 31, 33 of hem 30, 32 and low tack surface 44 covered with removable protective cover 16, 16'. High tack surface 43 ensures that adhesive 15, 15' is retained on liner 10 and no residual is left on the waste container when liner 10 is removed therefrom. Adhesive strip 15, 15' is preferably continuous across hem 30, 32 but it is within the scope of this invention to provide for closely and regularly spaced applications of adhesive thus effectively producing a continuous strip. Though adhesive strip 15, 15' is typically one quarter inch (¼") in width and protective cover is one half inch (½") in width, it is fully within the scope of this invention to provide a narrower or wider strip. An adhesive for adhesive strip 15, 15' may be selected from the group comprising acrylic, styrene, isoprene, synthetic polyisoprene, butadiene-styrene (SBR) polymers, thermoplastic rubbers, blocked polymers thereof or combinations thereof and preferably is finger lift tape #7040 available from Bisco International, Inc., 543 Granville Ave., Hillside, Ill. 60162. Finger lift tape #7040 is a one quarter inch rubber based adhesive deposited on an one half inch wide polyethylene carrier and covered with a one half inch wide polyethylene protective cover 16, 16'. An alternative high tack/low tack tape, F9415PC-high-tack/low tack removable adhesive double coated film is available from Minnesota Mining Company, Building 21-1W-10, 900 Bush Avenue, St. Paul, Minn. 55144-1000.

In addition to adhesive strip 15, 15' placed on hems 30, 32 at least a portion of external surface of first wall 18 and/or second wall 20 may have an additional adhesive strip 45 affixed thereto at installation of liner 10 into a waste receptacle wherein adhesive strip 45 is used to reduce the periphery of liner 10. Adhesive strip 45 is preferably disposed transverse to adhesive strip 15, 15' affixed to hems 30, 32 when installing liner 10. Initially, additional adhesive strip 45 is covered with removable protective strips 46, 47 as additional adhesive strip 45 is packaged with, but separate from liner 10. Adhesive strip 45 is shown separated from liner 10 in FIG. 4 with dashed lines toward and onto liner 10 to show application of additional adhesive strip 45 to liner 10. When applying additional adhesive strip 45 to liner 10, protective cover 47 is removed exposing adhesive 45 whereupon additional adhesive strip 45 is applied to liner 10. Protective cover 46 is then removed exposing adhesive 45 and a portion of exterior surface 31 is folded over the exposed adhesive previously covered by protective cover 46 and hence, exterior surface 31 then assumes a new width 51. In the process of folding a portion of exterior surface 31, hem 30 is likewise folded and adhesive 15 at hem 30 is folded upon itself whereupon hem 30 is similarly reduced in length and held in place by a portion of adhesive 15 against another portion of adhesive 15 and thus liner 10 assumes a new periphery. Of course, more than one additional adhesive strip 45 may be applied to liner 10, however, it has been found by the inventor hereof that only one additional adhesive strip 45 is usually needed to sufficiently reduce the periphery of liner 10 for the purpose of placing liner 10 into a waste receptacle of a size smaller than the full periphery of liner 10. Though additional adhesive strip 45 has been hereinbefore described and shown in FIG. 4 as a separate rectangular strip approximately three quarters of an inch (¾") square, it is fully within the scope of this invention to provide a different shape, such as round or oval, for additional adhesive strip 45 and it is also within the scope of this invention to apply a surface thereof generally covered by protective cover 47 to each liner 10 leaving protective cover 46 in place.

Liner 10 is preferably rectangular in general shape, however, it is within the scope of this invention to provide for tapered terminal side edges 11, 12 by providing a "V" shaped edge sealing/cutting blade in edge sealer/cutter 109. Accordingly, liner 10 of a height of twelve inches (12") may assume a width 51 at hem 30, 32 of fourteen inches (14") and a width 51 at new base 49 of eleven (11) inches. It is within the scope of this invention to provide for different tapers to side edges 11, 12 as dictated by different tapered waste receptacles. Liner 10 has been designed to fit in round, square, rectangular or oval trash containers which may be made of ceramic, plastic, metal, wood or other materials. Primarily, liner 10 is best used in small trash containers typically measuring about thirteen inches (13") in height, though it is within the scope of this invention to provide liner 10 which can be used in larger containers and therefore this application is not intended to be restricted by the height parameter. Typical round waste receptacles for home bathrooms, bedrooms and/or offices have a circumference of about 28 inches and the perimeter of rectangular waste receptacles is about 30 inches while the perimeter for an oval waste receptacle is about 25 inches. Accordingly, liner 10 is manufactured to a width of fifteen inches (15") to provide a perimeter of 30 inches when opened and additional adhesive strip 45 is used to reduce the perimeter thereof when using liner 10 for oval or rectangular waste receptacles. For instance, oval or rectangular waste containers generally used in bathrooms and bedrooms are about twelve inches (12") as measured in the major direction and about eight inches (8") in the minor direction with a height of thirteen inches (13") or less. Round waste receptacles also generally used in bathrooms and/or bedrooms may be about ten inches (10") in diameter while square waste containers are about ten inches (10") square but still about thirteen inches (13") in height. Larger kitchen waste containers are usually greater than thirteen inches (13") in diameter and at least 18 inches in height.

In use, liner 10 is first opened and folded bottom 39 expanded outwardly and then inserted into a waste container whereupon liner 10 basically sits on an interior bottom surface of the container. Protective cover 16 covering pressure adhesive strip 15 on one hem 30 is removed by gripping a free end 52 thereof and completely removing protective cover 16 thereby exposing adhesive strip 15. Adhesive strip 15 is then pressed against an inside rim of the container and smoothed against the inside rim along the length thereof. Protective cover 16' on opposite hem 32 is then removed in a like manner and exposed pressure adhesive strip 15' is smoothed against a remainder of the inside rim of the waste container. If liner 10 is greater in circumference than the waste receptacle, additional adhesive strip 45 is placed on interior surface 28, 29 of liner 10 and a portion of interior surface 28, 29 folded over additional adhesive strip 45 thus reducing liner 10 in circumference. Thereafter, hem 30 or 32 contiguous with the interior surface receiving additional adhesive strip 45 is folded against itself whereupon adhesive 15, 15' adheres to itself in the area of the fold. It should be apparent here, that once adhesive strip 15, 15' is smoothed against the inside rim of the container and, if necessary, liner 10 reduced in circumference, as folded bottom 39 has been opened and rests against the inside surface of the waste receptacle, liner 10 effectively fills the volume of the waste container. When the interior volume of liner 10 has received sufficient waste to approach its total capacity, a portion of draw tapes 38, 48 exposed in cutouts 36 is taken hold of and gently pulled, thus separating liner 10 away from the waste container thus allowing for clean and sanitary removal of liner 10 containing waste. Liner 10 of FIG. 4 may similarly be inserted and removed from a waste container though liner 10 of FIG. 4 will not typically stand erect on an inside surface of the bottom of a waste receptacle.

In one method of manufacturing waste can liner 10, a thermoplastic extruder 110 produces a thin wall tube of extrudate which is expanded greatly in diameter by introducing air into, and capturing the air within, the heated extrudate to produce a blown thermoplastic tube 101. Expanded thermoplastic tube 101 may then flattened into a double walled structure, ultimately becoming walls 18, 20 of liner 10, by passing expanded thermoplastic tube 101 through a flattening mechanism 102 such as a roller disposed at an angle to the direction of travel of expanded thermoplastic tube 101 from extruder 110. The double walled structure is slit along the length thereof by a tube slitter 104 thus creating walls 18, 20 having free ends 24, 26 respectively, walls 18, 20 joined together along a bottom 13. A bottom folder 103 produces a gusset, or "C" shaped, inwardly directed fold in bottom 13 of the double walled structure, bottom folder 103 reforming bottom 13 into a folded bottom 39. Separate free ends 24, 26 are folded inwardly and separately pressed by a hem folder 105 thus creating hems 30, 32 as fully described in the U.S. Pat. No. 6,602,174 B1 issued on 5 Aug. 2003 to Haverfield, et al., the entire specification thereof incorporated into this application by this reference thereto. As also described in the aforementioned reference to Haverfield, et al., at least one hem 30, 32 has a cutout 36 provided therethrough by a cutout punch 106, cutout 36 provided for access to a draw tape 38, 48 when removing liner 10 from a waste receptacle and closing liner 10, draw tapes 38, 48 inserted into hems 30, 32 respectively. Draw tapes 38, 48 are inserted into previously folded hems 30, 32 by introducing draw tapes 38, 48 at an angle to the machine direction (MD) of manufacturing of liners 10, draw tapes 38, 48 passing over separate rollers 111, 112 disposed in opened hem 30, 32 respectively. Rollers 111, 112 insert draw tapes 38, 48 adjacent an inside bight of portions 21, 23 respectively, draw tapes 38, 48 maintained in position by tension on draw tapes 38, 48. Terminal ends 25, 27 of walls 18, 20 respectively are sealed to interior surfaces 28, 29 of walls 18, 20, respectively, at a seam 34 by a hem sealer 107, hem sealer 107 preferably a thermoplastic sealing mechanism well known in the art for sealing thermoplastic materials. Upon closure of hems 30, 32, hems 30, 32 are further provided with adhesive strips 15, 15' on exterior surfaces 31, 33 thereof, adhesive strips 15, 15' of hems 30, 32 adapted for adhering liner 10 to an inside surface of a rigid waste container thus keeping liner 10 in an open posture within the waste container. As hereinbefore described, adhesive 15, 15' may be applied by an adhesive applicator 108 as a continuous strip approximately one-quarter inch in width, however, a continuous strip of adhesive 15, 15' is not limiting within the scope of this invention. Adhesive strips 15, 15' preferably have high tack surfaces 43 applied to exterior surfaces 31, 33 between seam 34 and a lower cusp 22 of cutout 36 with low tack surfaces 44 initially exposed. Adhesive strips 15, 15' may then be covered with removable covers 16, 16' by introducing removable covers 16, 16' at an angle to machine direction MD, removable covers 16, 16' rolled onto, and temporarily adhered to, adhesive strips 15, 15' by separate rollers 113, 114. Removable covers 16, 16' are shown as being introduced at a right angle to machine direction MD from one side, however it is fully within the scope of this invention to introduce removable covers 16, 16' from above and below apparatus 100. Upon rolling removable covers 16, 16' onto adhesive strips 15, 15', liners 10 are created by sealing side edges 11, 12 at sealing/severing joints 17. Preferably, however, adhesive strips 15, 15' are applied as a tape already disposed on a carrier (not shown) with covers 16, 16' removably applied to an opposite side of adhesive strips 15, 15'. This tape structure is applied to exterior surfaces 31, 33 by rollers 113, 114 by introducing the tape structure, including adhesive strips 15, 15' and covers 16, 16', at an angle to machine direction MD while removing the carrier. Side edges 11, 12 of adjacent liners 10 may remain joined at sealing/severing joints 17 whereupon liners 10 are disposed upon a roll 115 of apparatus 100 or may be separated at sealing/severing joints 17 and nested in a stack 116 for ultimate placement in a box or bag for consumer use.

Though the preferred method of making liner 10 has been described, it is fully within the scope of this invention to produce liner 10 by folding a sheet of suitable thermoplastic material first in half, folding each wall 18, 20 again backwardly from a first bottom fold 13' to establish inwardly directed "C" fold 14, folding a free end 24 of wall 18 inwardly to produce hem 30, folding free end 26 of wall 20 inwardly producing hem 32, cutting cutouts 36 in hems 30, 32 by suitable means, introducing draw tape 38 into hem 30 and draw tape 48 into hem 32, sealing hems 30, 32 at seam 34 by suitable means thus creating newly formed top edge 50, laying adhesive strips 15, 15' across width 51 of walls 18, 20 adjacent seam 34 on portions 21, 23 of free ends 24, 26 respectively, covering adhesive strips 15, 15' with protective covers 16, 16' and sealing side edges 11, 12 from newly formed top edge 50 to new bottom 49 whilst sealing side edges 35, 37 of inwardly directed "C" fold at side edges 11, 12. In either method of forming liner 10, waste can liner 10 is provided with draw strip 38, 48 enclosed in hem 30, 32 respectively at top end 50 thereof and a gusset fold 14 is provided in a bottom end 49 thereof. Hem 30, 32 is further provided with at least one cutout 36 therethrough for retrieving a portion of draw tape 38, 48 when closing liner 10, hem 30, 32 further provided with at least two adhesive strips 15, 15' on outside surface of hem 30, 32 for adhering liner 10 to an inside surface of a rigid container thus keeping liner 10 in an open posture within the container.

While the present invention has been described with reference to the above described preferred embodiments and alternate embodiments, it should be noted that various other embodiments and modifications may be made without departing from the spirit of the invention. Therefore, the embodiments described herein and the drawings appended hereto are merely illustrative of the features of the invention and should not be construed to be the only variants thereof nor limited thereto.

I claim:

1. A liner for a waste receptacle comprises a first wall, a second wall, at least one draw tape hem, at least one draw tape and at least one adhesive strip, said second wall comprising an extension of said first wall, said second wall laid adjacent said first wall, said draw tape hem comprising an extension of at least a portion of a free end of said first wall and at least a portion of a free end of said second wall, wherein a portion of said draw tape is laid adjacent a terminal end of said free end of said first wall, a portion of said draw tape is laid adjacent a terminal end of said free end of said second wall, said terminal end of said free end of said first wall folded over said portion of said draw tape and joined to an inside surface of said first wall and a terminal end of said free end of said second wall folded over said portion of said draw tape and joined to an inside surface of said second wall, said first wall and said second wall are joined together along terminal side edges thereof and wherein said adhesive strip is applied to an exterior surface of said draw tape hem wherein said liner is constructed of a transparent material and wherein said transparent material is provided with at least one decorative applique on at least one of an interior surface of said first wall and said second wall.

2. A liner as in claim 1 wherein said adhesive strip extends the length of said hem from one side edge of said liner to an opposite side edge thereof.

3. A liner as in claim 1 wherein said hem is provided with a cutout in a portion thereof for access to said draw tape.

4. A liner as in claim 3 wherein said cutout is centrally disposed in said hem to assist in separating said liner from said container.

5. A liner as in claim 1 wherein said first wall and said second wall are provided with an inwardly directed fold disposed therebetween opposite said free ends of said liner.

6. A liner as in claim 5 wherein said inwardly directed fold is joined to said terminal side edges.

7. A liner as in claim 1 wherein said adhesive strip comprises a high tack surface and a low tack surface, said high tack surface applied to said exterior surface of said hem and said low tack surface covered with a removable protective strip.

8. A liner as in claim 7 wherein said cutout is centrally disposed in said hem to assist in peeling said liner from said container.

9. A liner for a waste receptacle comprises a first wall, a second wall, at least one draw tape hem, at least one draw tape and at least one adhesive strip, said second wall comprising an extension of said first wall, said second wall laid adjacent said first wall, said draw tape hem comprising an extension of at least a portion of a free end of said first wall and at least a portion of a free end of said second wall, wherein a portion of said draw tape is laid adjacent a terminal end of said free end of said first wall, a portion of said draw tape is laid adjacent a terminal end of said free end of said second wall, said terminal end of said free end of said first wall folded over said portion of said draw tape and joined to an inside surface of said first wall and a terminal end of said free end of said second wall folded over said portion of said draw tape and joined to an inside surface of said second wall, said first wall and said second wall are joined together along terminal side edges thereof and wherein said adhesive strip is applied to an exterior surface of said draw tape hem wherein said liner is constructed of a transparent material and wherein said transparent material is provided with at least one decorative applique on at least one of an exterior surface of said first wall and said second wall.

10. A liner for a waste receptacle comprises a first wall, a second wall, at least one draw tape hem, at least one draw tape and at least one adhesive strip, said second wall comprising an extension of said first wall, said second wall laid adjacent said first wall, said draw tape hem comprising an extension of at least a portion of a free end of said first wall and at least a portion of a free end of said second wall, wherein a portion of said draw tape is laid adjacent a terminal end of said free end of said first wall, a portion of said draw tape is laid adjacent a terminal end of said free end of said second wall, said terminal end of said free end of said first wall folded over said portion of said draw tape and joined to an inside surface of said first wall and a terminal end of said free end of said second wall folded over said portion of said draw tape and joined to an inside surface of said second wall, said first wall and said second wall are joined together along terminal side edges thereof and wherein said adhesive strip is applied to an exterior surface of said draw tape hem wherein at least a portion of said exterior surface of said first wall is provided with an additional adhesive strip disposed transverse to said adhesive strip affixed to said hem, said additional adhesive strip covered with a removable protective strip, said additional adhesive strip adapted for reducing a periphery of said liner.

11. A method of manufacturing a waste can liner comprises the step of producing a thin wall tube of extrudate, said thin wall tube comprising a first wall and said second wall wherein said second wall consists of an extension of said first wall, said second wall laid adjacent said first wall, the step of expanding greatly in diameter said thin wall tube of extrudate by introducing air into, and capturing said air within said thin wall tube, the step of flattening said thin wall tube into a double walled structure by passing said expanded thin wall thermoplastic tube through a flattening mechanism, the step of slitting said double walled structure along a length thereof by a tube slitter creating spaced apart walls having free ends, said walls joined together along a bottom, the step of producing "C" shaped, inwardly directed fold in said bottom of said double walled structure with a bottom folder, the step of folding inwardly said separate free ends to produce draw tape hems of said free ends, said draw tape hems comprising an extension of at least a portion of a free end of said first wall and at least a portion of a free end of said second wall, the step of separately pressing said hems with a hem folder, the step of providing a cutout through at least one said hem by a cutout punch, the step of inserting draw tapes into said hems adjacent inside bight of portions of said hems, the step of sealing said terminal ends of said walls to separate interior surfaces of said walls by a hem sealer, the step of providing adhesive strips on exterior surfaces of said hems, said adhesive strips provided with a removable cover, the step of sealing side edges of said walls and the step of rolling said liners upon a roll wherein said liner is constructed of a transparent material and wherein said transparent material is provided with at least one decorative applique on at least one of an interior surface of said first wall and said second wall.

12. A method as in claim 11 wherein said step of providing said adhesive strips comprises the further step of applying a high tack surface to said exterior surfaces between a seam adjacent said free ends of said walls and a lower cusp of said cutout.

13. A method as in claim 11 wherein said step of providing said adhesive strip further comprises the step of covering an exposed low tack surface of said adhesive strip with said removable cover.

* * * * *